US010394167B2

(12) United States Patent
Tanaka

(10) Patent No.: US 10,394,167 B2
(45) Date of Patent: Aug. 27, 2019

(54) IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 134 days.

(21) Appl. No.: 15/492,536

(22) Filed: Apr. 20, 2017

(65) Prior Publication Data

US 2018/0081303 A1 Mar. 22, 2018

(30) Foreign Application Priority Data

Sep. 16, 2016 (JP) ..... 2016-182142
Dec. 26, 2016 (JP) ..... 2016-250304

(51) Int. Cl.
*G03G 15/16* (2006.01)
*G03G 15/00* (2006.01)

(52) U.S. Cl.
CPC ..... *G03G 15/1615* (2013.01); *G03G 15/167* (2013.01); *G03G 15/757* (2013.01); *G03G 15/5054* (2013.01)

(58) Field of Classification Search
None
See application file for complete search history.

(56) References Cited

U.S. PATENT DOCUMENTS 8,165,498 B2 * 4/2012 Hoshino ..... G03G 15/1685 399/121
8,639,137 B2 * 1/2014 Torimaru ..... G03G 15/167 399/44
2004/0041529 A1 * 3/2004 Carter ..... B65H 29/12 318/86
2007/0212129 A1 * 9/2007 Takemoto ..... G03G 15/161 399/313
2008/0298856 A1 12/2008 Koike
2013/0084086 A1 4/2013 Ikeda
2016/0216649 A1 7/2016 Matsuda et al.

FOREIGN PATENT DOCUMENTS

JP 2009-9103 A 1/2009
JP 2009-294370 A 12/2009
JP 2010-175720 A 8/2010
JP 2013-76948 A 4/2013
JP 2016-139115 A 8/2016

* cited by examiner

*Primary Examiner* — Roy Y Yi
(74) *Attorney, Agent, or Firm* — Sughrue Mion, PLLC

(57) ABSTRACT

An image forming apparatus includes:
an image carrier that carries an image formed on an outer circumferential surface thereof and that circularly moves;
a circulating member that circularly moves and receives a transfer of the image from the image carrier on an outer circumferential surface thereof that is in contact with the outer circumferential surface of the image carrier or on a recording material;
a first driving unit that drives the image carrier to circularly move;
a second driving unit that drives the circulating member to circularly move by a driving force independent from a driving force of the first driving unit;
a load detector that detects a driving load of at least one of the first and second driving units; and
a driving adjuster that regulates the driving by the second driving unit so that the load detected by the load detector becomes a predetermined load.

12 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2016-182142 filed Sep. 16, 2016 and Japanese Patent Application No. 2016-250304 filed on Dec. 26, 2016.

BACKGROUND

Technical Field

The present invention relates to an image forming apparatus.

SUMMARY

According to an aspect of the invention, an image forming apparatus includes:

an image carrier that carries an image formed on an outer circumferential surface thereof and that circularly moves along the outer circumferential surface;

a circulating member that circularly moves along an outer circumferential surface thereof and receives a transfer of the image from the image carrier on the outer circumferential surface thereof that in contact with the outer circumferential surface of the image carrier or on a recording material that is transported while being nipped between the outer circumferential surface of the image carrier and the outer circumferential surface of the circulating member;

a first driving unit that drives the image carrier to circularly move;

a second driving unit that drives the circulating member to circularly move by a driving force independent from a driving force of the first driving unit;

a load detector that detects a driving load of at least one of the first and second driving units; and a driving adjuster that regulates the driving by the second driving unit so that the load detected by the load detector becomes a predetermined load.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described.

Figure 1:
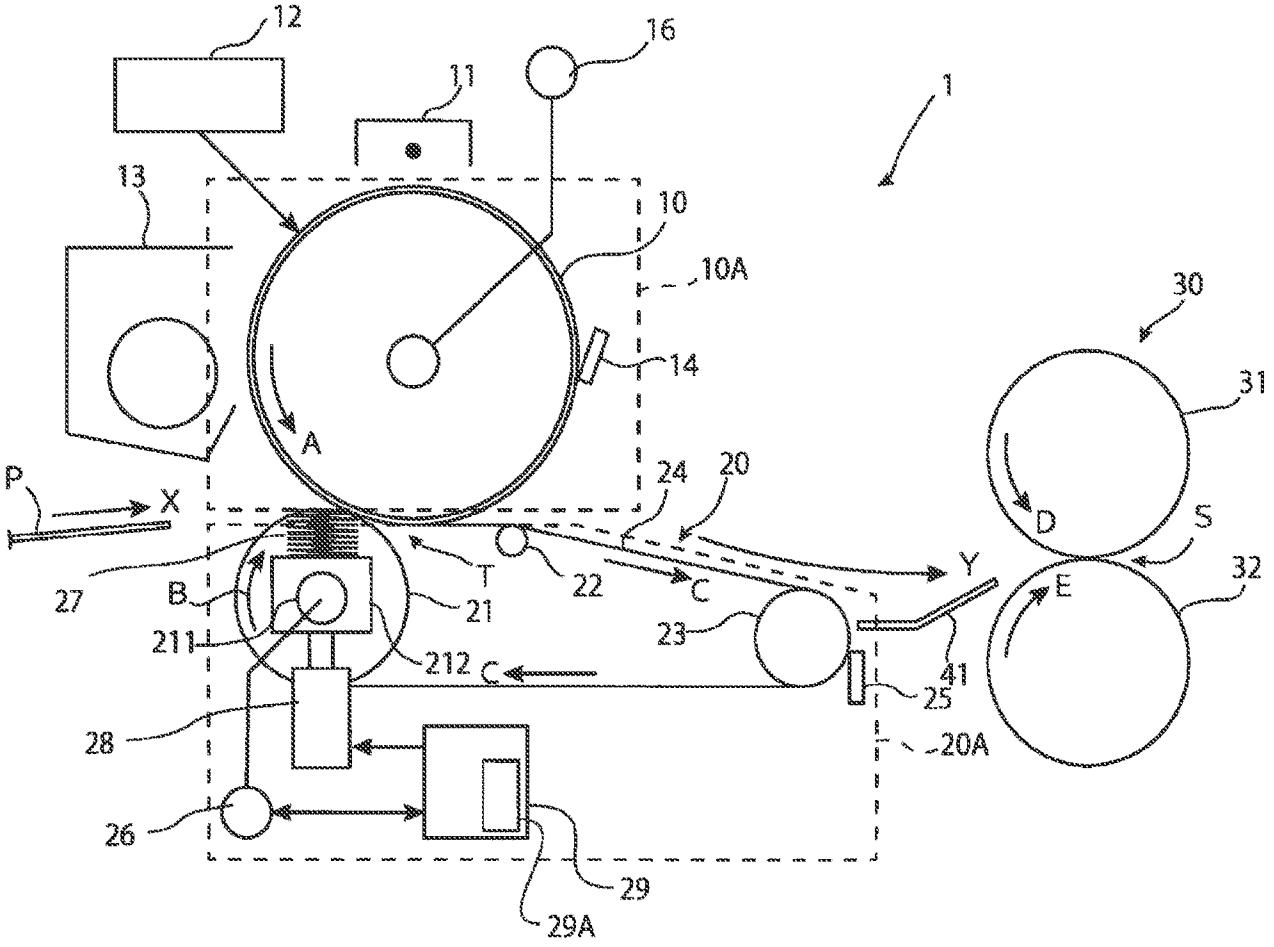
FIG. 1 is a view schematically illustrating a configuration of an image forming apparatus as an exemplary embodiment of the present invention.

FIG. 1 is a view schematically illustrating a configuration of an image forming apparatus as an exemplary embodiment of the present invention.

The image forming apparatus 1 is a so-called monochrome printer using a direct transfer method.

The image forming apparatus 1 includes a photoconductor drum 10. The photoconductor drum 10 is rotatably supported by a drum support frame 110A and driven by a photoconductor motor 16 to be rotated in the direction of the arrow A. A charging unit 11, an exposure unit 12, and a developing device 13 are provided around the photoconductor drum 10. A toner image is formed on the surface of the photoconductor drum 10 through the respective processes of charging by the charging unit 11, exposure by the exposure unit 12, and development by the developing device 13. The toner image is carried on the photoconductor drum 10. Here, the exposure unit 12 exposes the photoconductor drum 10 according to image data sent from the outside of the image forming apparatus 1, and the image represented by the image data is formed as the toner image on the photoconductor drum 10. In order to ensure the accuracy of the exposure, the photoconductor drum 10 is driven by the photoconductor motor 16 at a stable rotation speed. The photoconductor drum 10 corresponds to an example of an image carrier of the present invention, and the photoconductor motor 16 corresponds to an example of a first driving unit of the present invention.

Meanwhile, paper P as a type of a recording material (a so-called cut paper) is transported by a paper transport unit (not illustrated) in the direction of the arrow X and passes a transfer region T between the photoconductor drum 10 and a transfer device 20 to be described later. Then, the toner image on the photoconductor drum 10 is transferred onto the paper P while the paper P passes the transfer region T. After the transfer of the toner image in the transfer region T, the remaining toner on the photoconductor drum 10 is removed by a cleaner 14 from the photoconductor drum 10.

The paper P onto which the toner image has been transferred in the transfer region T is further transported in the direction of the arrow Y to be sent to a fixing device 30. The fixing device 30 includes a heating roller 31 that is rotated in the direction of the arrow D, and a pressure roller 32 that is rotated in the direction of the arrow E. The heating roller 31 and the pressure roller 32 are in contact with each other to form a fixing region S. The paper P that has been transported in the direction of the arrow Y enters the fixing region S, and the toner image on the paper P is heated and pressed while the paper P passes the fixing region S so as to be fixed on the paper P. As a result of the fixing, an image composed of the fixed toner image is formed on the paper P. The paper 7 on which the image has been formed is sent to the outside of the image forming apparatus 1 by a paper discharging unit (not illustrated).

The transfer device 20 includes a transfer roller 21, a pressure contact roller 22, a separation roller 23, and an endless transfer belt 24 looped around the rollers. The transfer roller 21, the pressure contact roller 22, and the separation roller 23 are rotatably supported by a transfer unit support frame 20A.

The transfer roller 21 is driven by a transfer motor 26 to be rotated in the direction of the arrow B and drives the transfer belt 24. The transfer belt 24 is a resin belt having a low elasticity and circularly moves in the direction of the arrow C by a driving force from the transfer roller 21. The transfer belt 24 corresponds to an example of a circulating member of the present invention, and the transfer motor 26 corresponds to an example of a second driving unit of the present invention.

The transfer roller 21 is disposed upstream of the rotation center axis of the photoconductor drum 10 in the paper traveling direction, and presses the transfer belt 24 against the photoconductor drum 10 from the internal side of the transfer belt 24. The upstream end of the transfer region T where the photoconductor drum 10 and the transfer belt 24 are in contact with each other is defined by the transfer roller 21.

In addition, the pressure contact roller 22 is disposed downstream of the rotation center axis of the photoconductor drum 10 in the paper traveling direction, and pushes up the transfer belt 24 toward the photoconductor drum 10 side from the internal side of the transfer belt 24. The downstream end of the transfer region T is defined by the pressure contact roller 22.

In addition, the separation roller 23 has a smaller diameter than that of the transfer roller 21. The separation roller 23 rapidly curves the traveling direction of the transfer belt 24 to thereby separate the leading end of the paper P in a state of being placed on the transfer belt 24 from the transfer belt 24. The paper P separated from the transfer belt 24 is guided by a guide member 41 to travel in the direction of the arrow Y and sent to the fixing device 30 as described above.

In addition, the transfer device 20 includes a cleaner 25. Toner or other contaminants attached to the transfer belt 24 are removed by the cleaner 25 from the transfer belt 24.

The transfer roller 21 is connected to a power supply (not illustrated), and a transfer bias is applied from the power supply to the transfer roller 21. By the action of the transfer bias, the toner image on the photoconductor drum 10 is transferred onto the paper P while the paper P passes the transfer region T.

The transfer roller 21 has a rotation shaft 211, which is rotatably supported by a shaft support frame 212. The shaft support frame 212 is vertically movably supported by the transfer unit support frame 20A (see FIG. 1) that supports the entire transfer device 20.

A compression spring 27 is provided between the shaft support frame 212 and the drum support frame 10A to bias the shaft support frame 212 in a direction separating from the drum support frame 10A. Further, the transfer device 20 is provided with a solenoid 28 fixed to the transfer unit support frame 20A to push the shaft support frame 212 against the biasing force of the compression spring 27 toward the drum support frame 10A side. FIG. 1 illustrates the state where the transfer roller 21 presses the transfer belt 24 against the photoconductor drum 10 when the shaft support frame 212 is gushed by the solenoid 28.

The transfer device 20 includes a controller 29 provided with a CPU as an operation unit or a RAM or ROM as a memory 29A. The solenoid 28 is turned on/off by a control of the controller 29. When the solenoid 28 is turned off, the shaft support frame 212 is pressed by the compression spring 27 in the direction receding from the drum support frame 10A. As a result, the transfer roller 21 and the transfer belt 24 are spaced apart from the photoconductor drum 10. The combination of the compression spring 27 and the solenoid 28 corresponds to an example of a contacting/separating device of the present invention.

The controller 29 not only controls the driving of the transfer roller 21 by the transfer motor 26, but also detects a load of the transfer motor 26 by monitoring a driving current supplied to the transfer motor 26. The controller 29 stores the detected load in the memory 29A. Then, the controller 29 controls the driving of the transfer motor 26 based on the detected load so as to adjust the driving of the transfer belt to conform to the circumferential face speed of the photoconductor drum 10. The controller 29 corresponds to an example that also serves as a load detector and a driving adjuster of the present invention, and the memory 29A corresponds to an example of a memory of the present invention.

Figure 2:
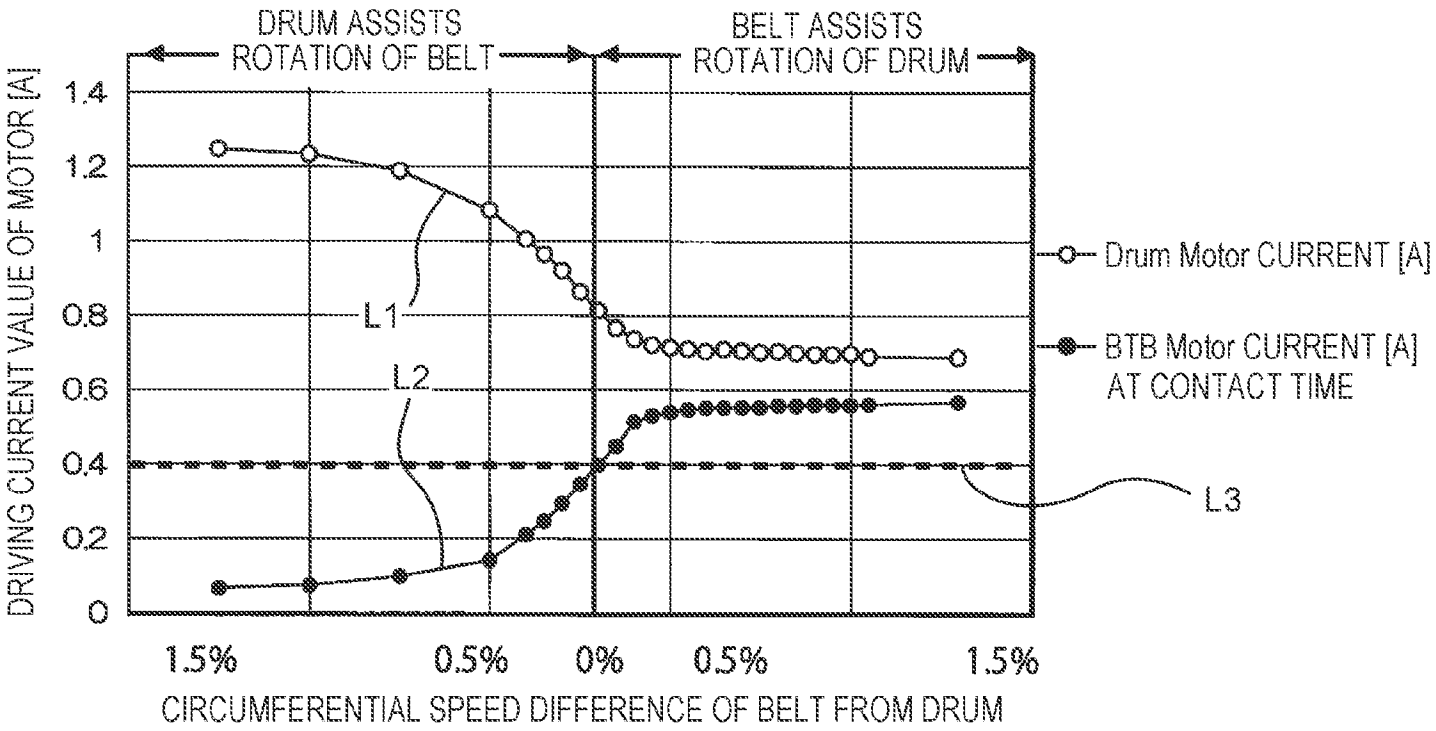
FIG. 2 is a graph for explaining a driving control.

FIG. 2 is a graph for explaining a driving control.

In FIG. 2, the horizontal axis represents a circumferential speed difference between the transfer belt 24 and the photoconductor drum 10 as a ratio to the circumferential speed of the photoconductor drum 10, and the vertical axis represents driving current values of the motors. In addition, in the graph illustrated in FIG. 2, the curve L1 marked with white circles represents a driving current value of the photoconductor motor 16, and the curve L2 marked with black circles represents a driving current value of the transfer motor 26 that drives the transfer roller 21 in the state where the transfer belt 24 is in contact with the photoconductor drum 10. In addition, the dashed curve 13 represents a driving current value of the transfer motor 26 that drives the transfer roller 21 in the state where the transfer belt 24 is spaced apart from the photoconductor drum 10.

The driving current values of the motors represent the driving loads of the motors. Since no external force is applied from the photoconductor drum 10 to the transfer belt 24 in the state where the transfer belt 24 is spaced apart from the photoconductor drum 10, the driving current value of the transfer motor 26 does not substantially change when the circumferential speed of the transfer belt 24 is stable, as represented by the dashed curve L3.

Meanwhile, the curve L1 marked with the white circles and the curve 12 marked with the black circles represent the driving current values of the motors in the state where the photoconductor drum 10 and the transfer belt 24 are in contact with each other.

Accordingly, when the photoconductor drum 10 and the transfer belt 24 are in contact with each other, the transfer motor 26 and the photoconductor motor 16 are in a state of mutually assisting the rotations. That is, in the left side of the graph, the curve L1 marked with the white circles is raised to exhibit a large load, and the curve 12 marked with the black circles is lowered to exhibit a small load. Thus, the left side of the graph represents that the photoconductor drum 10 is assisting the rotation of the transfer belt 24. To the contrary, in the right side of the graph, the curve L1 marked with the white circles is lowered, and the curve 12 marked with the black circles is raised. Thus, the right side of the graph represents that the transfer belt 24 is assisting the rotation of the photoconductor drum 10.

From the viewpoint of the driving current value of the transfer motor 26, in the left side of the graph, the curve 12 marked with the black circles is lower than the dashed curve 13. Thus, the driving load of the transfer motor 26 in the state where the transfer belt 24 is in contact with the photoconductor drum 10 is smaller than that in the free rotation state where no external force is applied from the photoconductor drum 10 to the transfer belt 24, and the transfer motor 26 receives the rotation assistance. In addition, in the right side of the graph, the curve 12 marked with the black circles is higher than the dashed curve 13. Thus, the driving load of the transfer motor 26 in the state where the transfer belt 24 is in contact with the photoconductor drum 10 is larger than that in the free rotation state, and the transfer motor 26 assists the rotation of the photoconductor drum 10.

Accordingly, the driving current value of the transfer motor 26 in the state where the transfer belt 24 is in contact with the photoconductor drum 10 is controlled based on the driving current value in the free rotation state so that the mutual rotation assistance relationship between the transfer belt 24 and the photoconductor drum 10 is adjusted. That is, when the driving current value in the state where the transfer belt 24 is in contact with the photoconductor drum 10 is controlled to be equal to the driving current value in the free rotation state, the transfer belt 24 and the photoconductor drum 10 are brought into a state where they do not mutually assist. In addition, when the driving current value in the state where the transfer belt 24 is in contact with the photoconductor drum 10 is controlled to be slightly larger than the driving current value in the free rotation state, the transfer belt 24 is brought into a state of slightly assisting the rotation of the photoconductor drum 10.

In an actual control, a driving control is performed for the driving of the transfer motor 26 that drives the transfer roller 21 to make the driving load larger than that in the free rotation state so that the transfer belt 24 is rotated faster by a circumferential speed difference of, for example, about 1% than the photoconductor drum 10. Accordingly, when the transfer belt 24 is rotated faster than the photoconductor drum 10, the transfer performance of the toner image from the photoconductor drum 10 to the transfer belt 24 is improved, and furthermore, a backlash of a gear incorporated in the driving system extending from the transfer motor 26 to the transfer roller 21 is prevented.

In addition, in the present exemplary embodiment, the driving current value in the free rotation state as a reference value of the driving control is re-detected by the controller with appropriate time intervals. Accordingly, the reference value of the driving control is reset, and the accuracy of the control is improved. Further, even when the re-detection is not performed, the driving current value in the free rotation state is used as a control reference value so that, for example, a machine difference of the image forming apparatus 1 is corrected, and the control accuracy is improved.

Next, another exemplary embodiment different from the above-described exemplary embodiment will be described. This exemplary embodiment has the same configuration as that illustrated in FIG. 1, except that the transfer belt 24 is an elastic belt made of, for example, a rubber having a higher elasticity than that of the transfer roller 21, instead of the resin belt. The transfer belt 24 as an elastic belt corresponds to an example of an elastic layer of the present invention, and in this case, the transfer roller 21 is regarded as an example of a rotation shaft of the present invention.

Even when the transfer belt 24 is an elastic belt, the rotation assistance relationship between the transfer belt 24 and the photoconductor drum 10 is determined by detecting the load of the transfer motor 26, and adjusted by controlling the driving of the transfer motor 26 to make the load of the transfer motor 26 have an appropriate value, as in the above-described exemplary embodiment. However, when the transfer belt 24 is an elastic belt, the driving current value in the free rotation state may not be appropriate as the reference value in controlling the driving of the transfer motor 26. Thus, in this exemplary embodiment, the reference value in controlling the driving of the transfer motor 26 is a fixed value of a driving current value which is measured and stored in advance in a state where the circumferential speed difference between the transfer belt 24 and the photoconductor drum 10 is confirmed as zero (0), for example, at the time of producing the apparatus. When the fixed value is used as the reference value, the control of the driving becomes simple.

In addition, in this exemplary embodiment, the driving of the transfer motor 26 is controlled so that the load of the transfer motor 26 becomes higher than that when the circumferential speed difference between the transfer belt 24 and the photoconductor drum 10 is zero (0). Accordingly, a hysteresis friction occurs between the transfer belt 24 as an elastic belt and the paper P, and the transportability of the paper P by the transfer belt 24 is improved.

In addition, the driving of the transfer motor 26 is controlled so that the load of the transfer motor 26 increases as the thickness of the paper P is thick. Through this control, the higher transportability is achieved as the thickness of the paper P is increased, and the paper P reliably passes between the transfer belt 24 and the photoconductor drum 10. In addition, the appropriate transportability according to the types of paper P may also be obtained when the driving of the transfer motor 26 is controlled so that the load of the transfer motor 26 increases as the surface of the paper P s smoother.

Subsequently, detailed description will be made on a condition for each of (i) a case where a control of the transfer motor 26 based on a driving current value in the free rotation state is suitable and (ii) a case where a control of the transfer motor 26 based on a fixed value of a driving current value is suitable.

Figure 3:
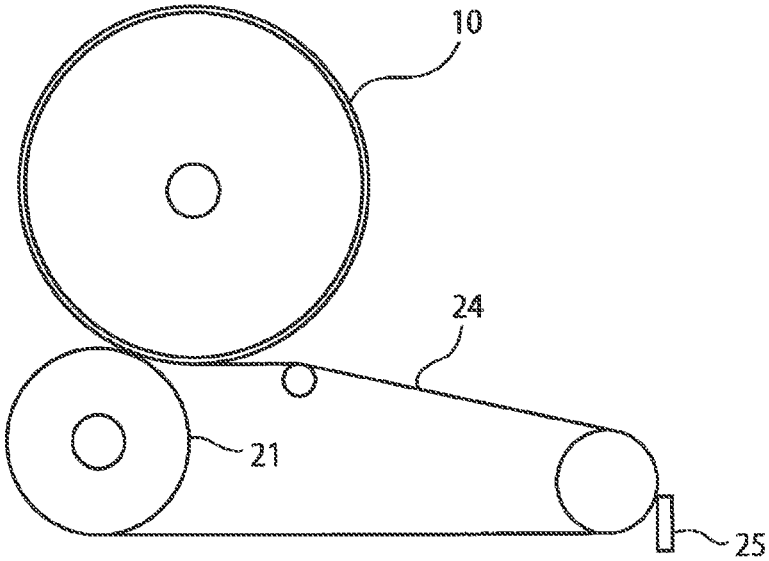
FIG. 3 is a view illustrating components extracted from the image forming apparatus of FIG. 1 to review a condition for an application of a control.

FIG. 3 is a view illustrating components extracted from the image forming apparatus 1 of FIG. 1 to review a condition for an application of a control.

As illustrated in FIG. 3, a transfer belt 24 is interposed between a photoconductor drum 10 and a transfer roller 21, and when a cleaner 25 or the like is in contact with the transfer belt 24, the cleaner 25 or the like becomes a load member that applies a rotational movement load to the transfer belt 24. This load is transmitted to the photoconductor drum 10 and the transfer roller 21 via the transfer belt 24. A photoconductor motor 16 that drives the photoconductor drum 10 and a transfer motor 26 that drives the transfer roller 21 share this load. From the inventor's review, it has been clear that the share of the load is determined by a modulus of rigidity ratio between the photoconductor drum 10 and the transfer roller 21. Here, the modulus of rigidity will be described.

Figure 4:
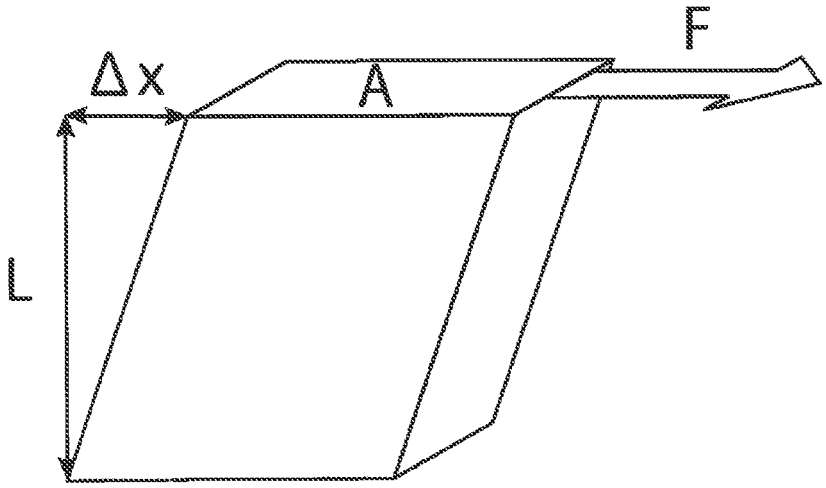
FIG. 4 is a view illustrating general quantities necessary to calculate a modulus of rigidity.

FIG. 4 is a view illustrating general quantities necessary to calculate a modulus of rigidity.

A modulus of rigidity indicates a hardness of an object against a shearing force. It is assumed that, as illustrated in FIG. 4, a displacement $\Delta x$ occurs by applying a force F to a surface of an object having a length (thickness) L and a cross-section area (surface area) A in the direction along the surface. A modulus of rigidity G is defined by a shearing stress $\tau xy$ and a shearing strain $\gamma xy$ as follows:

$$G=\tau xy/\gamma xy, \text{ and}$$

the shearing stress $\tau xy$ and the shearing strain $\gamma xy$ are respectively represented as $$\tau xy=F/A$$

$$\gamma xy=\Delta x/L$$

Accordingly, $$G=(F/A)/(\Delta x/L)=FL/A\Delta x.$$

Meanwhile, since the modulus of rigidity G is represented by the Young's modulus E and the Poisson's ratio ν as follows:

$$G=E/2(1+\nu),$$

a relational expression of E=f(E/L)Δx is obtained when the above expressions are combined with each other. Eventually, the force F and the displacement Δx are related to each other by f(E/L) equivalent to the spring constant, and this means that a roller shaped member (a roller member) such as the photoconductor drum 10 and the transfer roller 21 serves as a spring having the spring constant of f(E/L) against a force applied to the circumferential surface thereof in the tangent direction.

In addition, when a belt member C is interposed between roller members A and B like the photoconductor drum 10, the transfer roller 21, and the transfer belt 24 illustrated in FIG. 3, an external load transmitted via the belt member C is supported by the two parallel springs of the roller members A and B. The strength of each of the springs is proportional to the modulus of rigidity of each of the roller members A and B. Thus, when the modulus of rigidity of the roller member A is G1 and the modulus of rigidity of the roller member B is G2, the contributory distribution of an external load F0 transmitted via the belt member C is represented as follows:

$$\text{contribution proportion to the roller member } A=F0\times G1/(G1+G2)$$

$$\text{contribution proportion to the roller member } B=F0\times G2/(G1+G2)$$

For example, when the roller members A and B have the same modulus of rigidity, the contribution proportions become 1:1.

The external load F0 caused by the load member such as the cleaner 25 may be varied due to, for example, change in installation environment of the image forming apparatus 1, varied due to variation of members, varied due to variation in installation, and the like. Thus, the external load F0 becomes an error at the time of a driving load detection or a driving control of a roller member. Especially, when a control is performed based on a fixed value of a driving current value, and a load detection and a driving control are performed for an identical roller member side (e.g., the roller member B side), it is regarded that the contribution proportion of the external load F0 to the roller member of the controlled side entirely becomes an error. Accordingly, when the roller member of the controlled side (e.g., the roller member B) is more flexible than the roller member of the other side (e.g., the roller member A), the contribution proportion of the external load F0 to the controlled side is smaller than that of the other side, and thus, causes a small control error. Therefore, the driving control based on a fixed value of a driving current value is suitable.

The error caused from the external load F0 will be described in detail.

Figure 5:
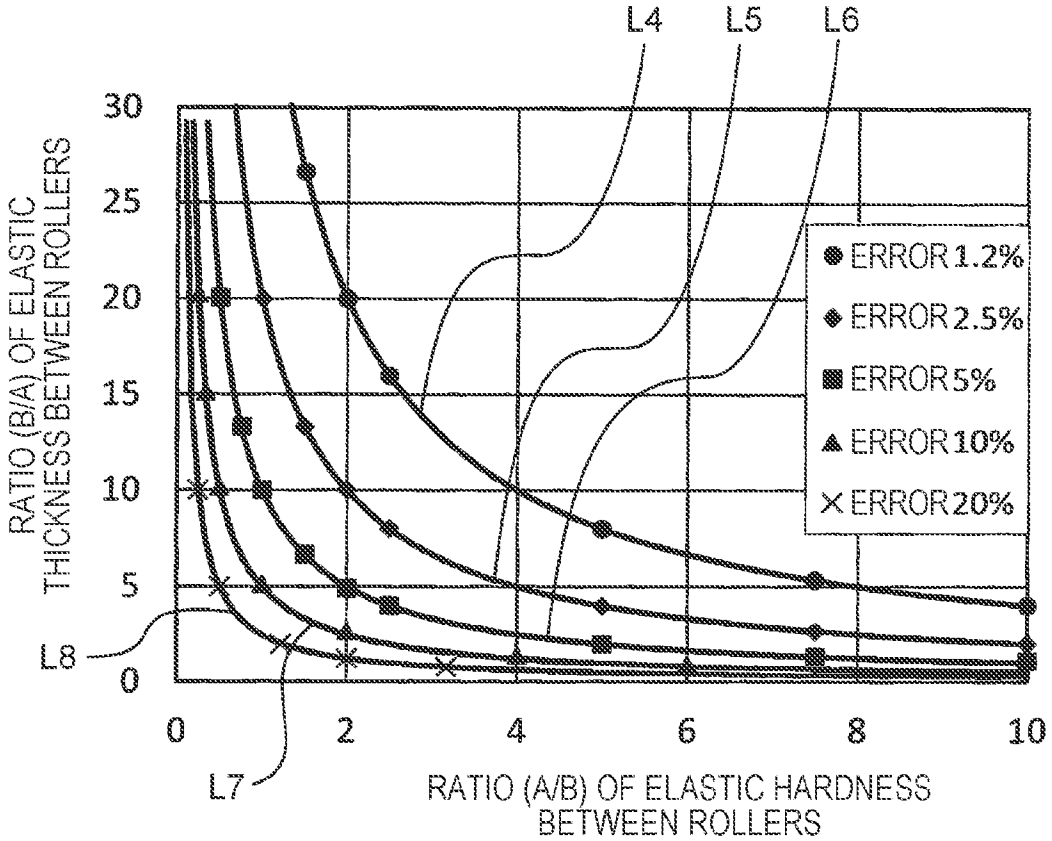
FIG. 5 is a graph illustrating an influence of a relative hardness between roller members A and B on a control error.

FIG. 5 is a graph illustrating an influence of a relative hardness between roller members A and B on a control error.

In FIG. 5, the horizontal axis indicates a ratio (A/B) of an elastic hardness (JIS-A hardness) between the roller members A and B, and the vertical axis indicates a ratio (B/A) of an elastic thickness between the roller members A and B.

The modulus of rigidity ratio between the roller members A and B is equal to the product of the elastic hardness ratio and the elastic thickness ratio. Accordingly, when the modulus of rigidity ratio is constant, an inverse proportional curve is obtained as in the graph of FIG. 5.

The curve L4 marked with circles represents a case where the roller member A is harder than the roller member B and has a modulus of rigidity ratio of 40. In this case, when a load detection and a driving control are performed for the side of the roller member B, the control error (i.e., the contribution proportion of the external load F0 to the roller member B) becomes 1.2% of the external load F0.

The curve 15 marked with rhombuses indicates a case where the modulus or rigidity ratio is 20. In this case, the error of the external load becomes 2.5%.

The curve 16 marked with squares indicates a case where the modulus of rigidity ratio is 10. In this case, the error of the external load becomes 5%.

The curve L1 marked with triangles indicates a case where the modulus of rigidity ratio is 5. In this case, the error of the external load becomes 10%.

The curve 18 marked with "×" indicates a case where the modulus of rigidity ratio is 2.5. In this case, the error of the external load becomes 20%.

When an error is large in the driving control of the roller member (e.g., the transfer roller 21), a problem occurs in controlling an image position at the transferring time. However, when the error is merely about 5%, no problem occurs in controlling the image position. Thus, when the roller member of the controlled side is flexible and has a modulus of rigidity ratio of 10 or more, the driving control is implemented with a sufficiently high accuracy by the control based on a fixed value of a driving current value. In other words, when the roller member of the controlled side is flexible to the extent that the contribution proportion of the external load to the controlled side is equal to or less than 5%, the drive control is implemented with a sufficiently high accuracy. From another viewpoint, when the roller member of the controlled side has a small spring constant against the force applied in the tangent direction of the circumferential surface of the roller member, and a spring constant ratio is equal to or more than 10, the driving control is implemented with a sufficiently high accuracy.

Hereinafter, the control error will be described by using specific examples.

When the roller member A is a photoconductor drum made of aluminum as a metal, and the roller member B is a transfer roller made of an foam elastic rubber with an elastic thickness of 8 mm and a hardness of 40, the elastic hardness ratio (A/B)=100/40=2.5. In addition, since the elastic thickness of the roller member A may be regarded as almost zero (0), the elastic thickness ratio (B/A)=8/0=∞. Thus, the modulus of rigidity ratio=elastic hardness ratio (A/B)×elastic thickness ratio (B/A)=∞, and the error of the external load may be regarded as almost 0%. Generally, when the roller member of the non-controlled side is made of a metal, and the roller member of the controlled side is made of a rubber, the error of the external load becomes almost 0%.

Next, description will be made on a case where both the roller members A and B are made of a rubber, the roller member A has an elastic thickness of 0.5 mm and a hardness of 70, and the roller member B has an elastic thickness of 6 mm and a hardness of 30. In this case, the elastic hardness ratio (A/B)=70/30=2.3 and the elastic thickness ratio (B/A) =6/0.5=30. Thus, the modulus of rigidity ratio=elastic hardness ratio (A/B)×elastic thickness ratio (B/A)=69. In this case as well, the error of the external load may be regarded as being almost 0%.

Next, description will be made on a case where the roller member A is a photoconductor drum made of aluminum, and the roller member B is a transfer roller made of aluminum. In this case, the elastic hardness ratio (A/B)=100/100=1, and the elastic thickness ratio (B/A)=0/0=1. Accordingly, since the modulus of rigidity ratio=elastic hardness ratio (A/B)× elastic thickness ratio (B/A)=1, the error of the external load becomes 50%. In this case, a problem may occur in the control based on a fixed value of a driving current value.

However, in order to make the external load F0 shared between the roller members A and B as described above, it is Premised that the load member such as the cleaner 25 is in contact with the belt member C at a site different from the site where the controlled-side roller member (e.g., the roller member B) is in contact with the belt member C. In this case, the load member corresponds to an example of a first load member defined in the invention.

Meanwhile, when the load member applies an external load to the rotating movement of the controlled-side roller member, the load member corresponds to an example of a second load member of the invention, and the sharing of the load as described above does not occur.

Figure 6:
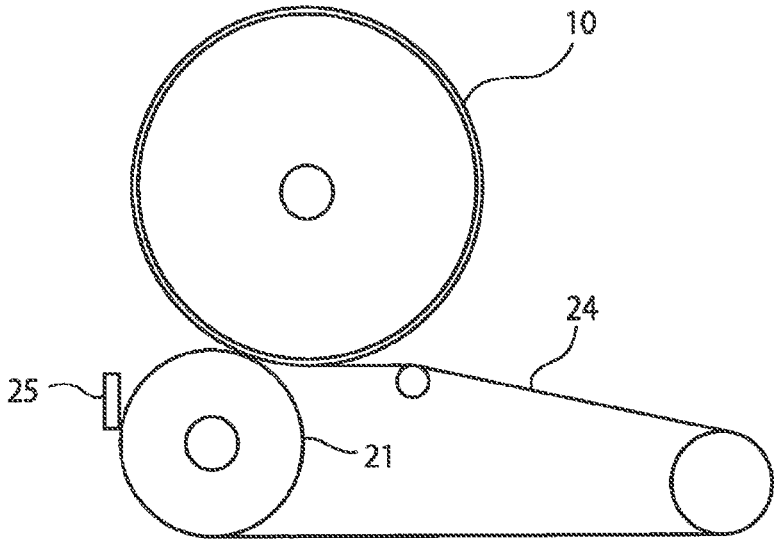
FIG. 6 is a view illustrating a case where an exemplary second load member defined in the invention is provided.

FIG. 6 is a view illustrating a case where an exemplary second load member defined in the invention is provided.

FIG. 6 illustrates a state where the transfer belt 24 is interposed between the photoconductor drum 10 and the transfer roller 21 as in FIG. 3. However, unlike FIG. 3, the cleaner 25 is in contact with the transfer belt 24 at a site where the cleaner 25 faces the transfer roller 21 with the transfer belt 24 interposed therebetween. Since the transfer-belt 24 is interposed between the cleaner 25 and the transfer roller 21, the cleaner 25 applies a rotational movement load to the transfer roller 21. In the arrangement illustrated in FIG. 6, the external load caused by the cleaner 25 is entirely borne by the transfer roller 21, and the photoconductor drum 10 does not share the external load.

As described above, when the external load is caused to the side of the transfer roller 21 (i.e., the controlled side) and is not caused to the side of the photoconductor drum 10, it corresponds to a case where only an internal load is caused to the transfer roller 21. Thus, the driving control of the transfer roller 21 (e.g., the control of the transfer motor 26) based on a driving current value in the free rotation state is suitable.

Meanwhile, the second load member defined in the invention is not only the load member in a case where the belt member is interposed between the load member and the roller member of the controlled side, but also a load member in contact with the roller member of the controlled side in a case where the roller member of the controlled side and the roller member of the non-controlled side are in direct contact with each other, and the belt member is not used.

In the above description, a cut paper is described as an example of the recording material of the present invention. However, the recording material of the present invention may be a continuous paper.

In addition, in the above description, a monochrome printer is described as an exemplary embodiment of the image forming apparatus of the present invention. However, the image forming apparatus of the present invention may be a color printer, a copier, a facsimile, or a multifunction machine.

The foregoing description has disclosed the example where the load of the transfer motor 26 is detected to be used for the driving control of the transfer motor 26. However, as an exemplary embodiment of the present invention, the load of the photoconductor motor 16 may be detected to be used for the driving control of the transfer motor 26.

In the above description, the apparatus using the direct transfer method is described as an exemplary embodiment of the image forming apparatus of the present invention. However, the image forming apparatus of the present invention may be an apparatus using an indirect transfer method of transferring an image from the photoconductor onto a recording material via an intermediate transfer body. In the case of the apparatus using the indirect transfer method, the configuration of the present invention may be applied to a position where the image is primarily transferred from the photoconductor onto the intermediate transfer body or a position where the image is secondarily transferred from the intermediate transfer body onto the recording material.

In the above description, an elastic belt is described as an example of the elastic layer of the present invention. However, the elastic layer in the present invention may be an elastic layer formed on the surface of a roller-shaped member.

According to the image forming apparatus of the exemplary embodiment, a desired speed difference is implemented even with out performing a direct control or a direct detection for the image carrier or the circulating member. However, the image forming apparatus of the present invention may be used in conjunction with the direct control or the direct detection for the image carrier or the circulating member, for example, for the purpose of achieving the control with a high accuracy.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to carry an image formed on an outer circumferential surface of the image carrier;

a circulating member configured to rotate and configured to receive the image from the image carrier on an outer circumferential surface of the circulating member that is in contact with the outer circumferential surface of the image carrier or on a recording material that is transported while being nipped between the outer circumferential surface of the image carrier and the outer circumferential surface of the circulating member;

a first driving unit configured to drive the image carrier;

a second driving unit configured to drive the circulating member by a driving force independent from a driving force of the first driving unit;

a load detector configured to detect a driving load of at least one of the first and second driving units; and a driving adjuster configured to regulate the driving by the second driving unit based on a free rotation state load of the second driving unit.

2. The image forming apparatus according to claim 1, wherein the driving adjuster configured to regulate the driving by the second driving unit so that the load detected by the load detector becomes a predetermined fixed value.

3. The image forming apparatus according to claim 1, further comprising:

a contacting/separating device configured to change a relative position between the circulating member and the image carrier between a contact position where the circulating member and the image carrier are in contact with each other and a separated position where the circulating member and the image carrier are separated from each other; and a memory configured to store the load detected by the load detector when the circulating member and the image carrier are at the separated position, wherein the driving adjuster is configured to regulate the driving by the second driving unit so that the load detected by the load detector at the contact position becomes a load having a predetermined relationship with respect to the load stored in the memory.

4. An image forming apparatus comprising:

an image carrier configured to carry an image formed on an outer circumferential surface of the image carrier;

a circulating member configured to rotate and configured to receive the image from the image carrier on an outer circumferential surface of the circulating member that is in contact with the outer circumferential surface of the image carrier or on a recording material that is transported while being nipped between the outer circumferential surface of the image carrier and the outer circumferential surface of the circulating member;

a first driving unit configured to drive the image carrier;

a second driving unit configured to drive the circulating member by a driving force independent from a driving force of the first driving unit;

a load detector configured to detect a driving load of at least one of the first and second driving units; and a driving adjuster configured to regulate the driving by the second driving unit so that the load detected by the load detector becomes a predetermined load, wherein the driving adjuster is configured to regulate the driving by the second driving unit in a range where a load of the second driving unit when receiving the transfer of the image is larger than a load of the second driving unit in a free state where no external force is applied to the outer circumferential surface of the circulating member.

5. The image forming apparatus according to claim 1, wherein the circulating member configured to receive the transfer of the image on the recording material, and the driving adjuster is configured to regulate the driving by the second driving unit so that the load detected by the load detector becomes the predetermined load depending on a type of the recording material.

6. The image forming apparatus according to claim 1, wherein at least one of the image carrier and the circulating member includes an elastic layer having a higher elasticity than that of a rotation shaft that receives the driving force of at least corresponding one of the first and second driving units, the elastic layer forming the outer circumferential surface of the at least one of the image carrier and the circulating member.

7. An image forming apparatus comprising:

an image carrier configured to carry an image formed on an outer circumferential surface of the image carrier;

a circulating member configured to rotate and configured to receive the image from the image carrier on an outer circumferential surface of the circulating member that is in contact with the outer circumferential surface of the image carrier or on a recording material that is transported while being nipped between the outer circumferential surface of the image carrier and the outer circumferential surface of the circulating member;

a first driving unit configured to drive the image carrier;

a second driving unit configured to drive the circulating member by a driving force independent from a driving force of the first driving unit;

a load detector configured to detect a driving load of at least one of the first and second driving units; and a driving adjuster configured to regulate the driving by the second driving unit so that the load detected by the load detector becomes a predetermined load, wherein:

the load detector is configured to detect the driving load of the second driving unit, the second driving unit is configured to drive a rotating body that drives the circulating member, the circulating member includes a first load member that applies a load to the circulating movement of the circulating member, at a position other than a position where the circulating member is in contact with the rotating body, and the rotating body includes an elastic layer having a modulus of rigidity smaller than that of the outer circumferential surface of the image carrier.

8. The image forming apparatus according to claim 7, wherein the rotating body includes the elastic layer having the modulus of rigidity equal to or less than 1/10 of the modulus of rigidity of the outer circumferential surface of the image carrier.

9. The image forming apparatus according to claim 7, wherein the image carrier is made of a metal, and the elastic layer of the rotating body is made of a rubber.

10. The image forming apparatus according to claim 8, wherein the image carrier is made of a metal, and the elastic layer of the rotating body is made of a rubber.

11. The image forming apparatus according to claim 3, wherein the load detector is configured to detect the driving load of the second driving unit, and the second driving unit drives a rotating body integrated with the circulating member or a rotating body that is separate from the circulating member and that drives the circulating member, the image forming apparatus further comprising:

a second load member that applies a load to a rotation of the rotating body.

12. The image forming apparatus according to claim 1, wherein the free rotation state load representing a driving current value of the second driving unit in the state where the circulating member is spaced apart from the image carrier.

* * * * *